United States Patent [19]

Nagasaki et al.

[11] 4,077,615

[45] Mar. 7, 1978

[54] SUCTION HEADS FOR THE REMOVAL OF SCUM

[75] Inventors: Katsumi Nagasaki, Osaka; Yoshihiro Inoue, Nishinomiya; Hiroyuki Yamazaki, Amagasaki; Akifumi Yano; Tetsuo Momose, both of Osaka, all of Japan

[73] Assignee: Kubota, Ltd., Osaka, Japan

[21] Appl. No.: 802,656

[22] Filed: Jun. 2, 1977

[30] Foreign Application Priority Data

Jun. 11, 1976 Japan ..... 51-69235

[51] Int. Cl.[2] ..... C21C 7/00

[52] U.S. Cl. ..... 266/201; 266/227

[58] Field of Search ..... 75/24, 30; 266/89, 201, 266/227

[56] References Cited

U.S. PATENT DOCUMENTS 3,979,108 9/1976 Nagasaki et al. ..... 266/201

*Primary Examiner*—Gerald A. Dost

*Attorney, Agent, or Firm*—Joseph W. Farley

[57] ABSTRACT

A suction head for apparatus for removing slag or scum from the surface of molten metal or the like includes a suction pipe having a scum inlet at one end and communicating at the other end with a suction source by way of a conduit, a scum separator, etc. The suction head further includes a water cooling jacket provided around the suction pipe at least close to the scum inlet, and a water injector for injecting the water in the jacket into the suction pipe at a position close to the scum inlet. The water injection comprises a first nozzle for forcing out the water toward the axis of the suction pipe to cause the water to impinge against the sucked scum and to thereby rapidly solidify the scum on cooling, and a second nozzle for injecting the water into the suction pipe along the inner peripheral surface thereof to prevent the adhesion of the scum to the inner surface of the suction pipe. When desired, a water flow channel from the jacket to the first and second nozzles is provided with a shutter for closing the channel in an emergency to prevent the water from falling onto the molten metal.

11 Claims, 7 Drawing Figures

SUCTION HEADS FOR THE REMOVAL OF SCUM

This invention relates to suction heads for use in apparatus for removing slag or scum from the surface of molten metal or the like by suction.

We have already provided a method and an apparatus for efficiently removing slag from the surface of molten metal by suction as disclosed in U.S. Pat. No. 3,979,108. The method consists essentially of sucking slag through a slag or scum inlet in communication with suction means, forcing out water against the sucked slag to cool and solidify the slag, separating the solid slag and water from the sucked air flow containing a mixture of the slag, water and resulting water vapor to discharge the slag and water from the air flow channel, and releasing the remaining air flow into the atmosphere by the suction means. The apparatus for practicing this method comprises a suction head, a conduit, a slag separator and the suction means. The suction head includes a suction pipe having the scum inlet, a water cooling jacket provided around the suction pipe and positioned at least close to the scum inlet, and means for injecting the water in the jacket into the suction pipe at a position close to the scum inlet. More specifically, the water injecting means includes orifices and/or nozzles arranged in the vicinity of the scum inlet and adapted to inject the water toward the axis of the suction pipe, such that the injected water impinges against the slag drawn from the scum inlet, cooling and pelletizing the slag. Generally, the apparatus has achieved the desired result as contemplated.

However, the suction head of the structure described still remains to be improved for more efficient operation. Although the water forced out from the orifices and/or nozzles against the sucked scum cools and solidifies the scum and further pelletizes the scum under favorable conditions, the apparatus has the drawback that the scum tends to adhere to the inner peripheralsurface of the suction pipe. The adhesion of the scum constricts the flow passage of the suction pipe, sometimes presenting difficulty in sucking up the scum smoothly or possibly clogging up the passage due to accelerated scum deposition.

The main object of this invention is to provide a suction head which is operable free of the adhesion of scum to the inner peripheral surface of the suction pipe.

To fulfill this object, the present invention provides a suction head in which the above-mentioned water injecting means includes a first nozzle for forcing out water toward the axis of the suction pipe and a second nozzle for injecting water into the suction pipe along the inner peripheral surface thereof. With this suction head, the water forced out from the first nozzle rapidly cools and solidifies the scum and, at the same time, the water from the second nozzle forms a water film flowing along the inner peripheral surface of the suction pipe to prevent the adhesion of the scum to the inner peripheral surface of the suction pipe, thus ensuring a smooth scum sucking operation.

According to a preferred embodiment of this invention, a water flow channel by which the interior of the water cooling jacket communicates with the first and second nozzles comprises water ports formed in the suction pipe and maintaining the interior of the water cooling jacket in communication with the interior of the suction pipe, and a branch portion formed on the inner peripheral surface of the suction pipe and communicating with the water ports and with the first and second nozzles.

With this embodiment, the adhesion of scum to the inner surface of the suction pipe can be prevented almost completely, rendering the suction pipe operable free of clogging. However, should the suction pipe be clogged up, a reduced suction will act in the vicinity of the scum inlet, possibly permitting the injected water to fall onto the molten metal without being sucked upward. Some means must therefore be provided to eliminate such objection and to ensure perfect safety. The safety means will be useful also in an event of suction failure or when the suction drops due to a malfunction of the suction means or of some other component or due to a power failure.

Another object of this invention is to provide a suction head including such safety means. For this purpose, the invention provides a suction head incorporating shutter means for closing the water flow channel.

Thus according to another preferred embodiment of this invention, the water flow channel comprising water ports formed in the suction pipe and a branch portion for passing water from the water ports into the first and second nozzles is provided with shutter means for closing or opening the water ports.

Various other features and advantages of this invention will be readily understood from the following description of embodiments of the invention given with reference to the accompanying drawings, in which.

Figure 1:
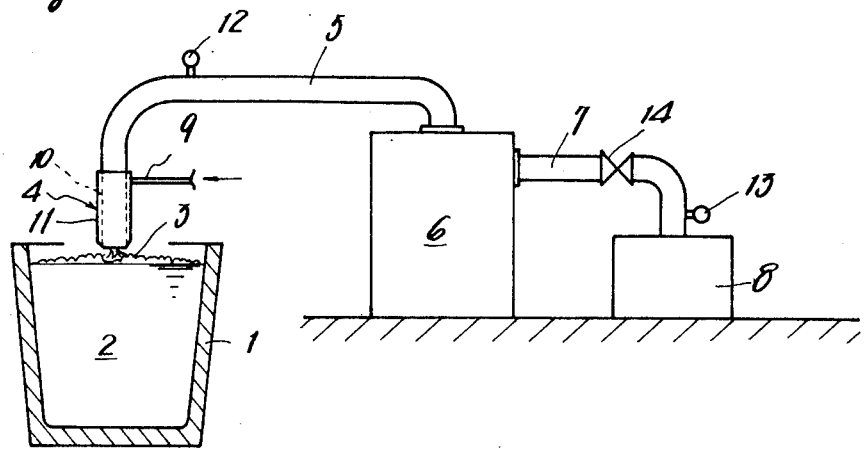
FIG. 1 is a diagram showing a suction head during use.

FIG. 1 shows a ladle 1, molten metal 2 and slag or scum 3 on the surface of the molten metal 2. Apparently, the slags, or more broadly the scums removable according to this invention include slag in Heroult electric furnaces, slag in ladles used in making steel, slag in low-frequency induction furnaces and reverberatory furnaces, slag in ladles for cupolas, slag produced in making rimmed steel, and slag produced in melting metals and various other materials and floating on the molten materials. A suction head 4 has a scum inlet at its lower end and communicates at the other end with suction means 8 by way of a conveying passage 5, a scum separator 6 and a connector pipe 7. The suction head 4 is cooled with water and is adapted to rapidly cool and solidify the sucked scum by forcing water against the scum. For this purpose, the suction head 4 includes a suction pipe 10 having a water cooling jacket 11 provided therearound and positioned close to the scum inlet. The jacket 11 is connected to a water supply duct 9. The water within the jacket 11 is injected into the suction pipe 10 by way of a water flow channel formed in the vicinity of the scum inlet. Indicated as 12 is a pressure detector for detecting the level of the negative pressure within the passage 5, at 13 another pressure detector disposed close to the inlet of the suction means 8, and at 14 a stop valve.

For the removal of the scum 3, the suction means 8 is operated, with the suction head 4 positioned at a suitable level above the scum 3. The scum is drawn into the suction head 4 from the scum inlet as entrained in the sucked air flow, whereupon water is forced out against the scum in the vicinity of the scum inlet. Consequently, the scum is rapidly cooled and solidified, preferably into pellets. The solid scum, the injected water, the resulting water vapor and the sucket air flow through the passage 5 into the scum separator 6, in which the scum and the water are separated from the sucked air and discharged from the passage for the sucked air flow. The sucked air containing the water vapor flows through the connector pipe 7 into the suction means 8, from which it is released into the atmosphere.

Figure 2:
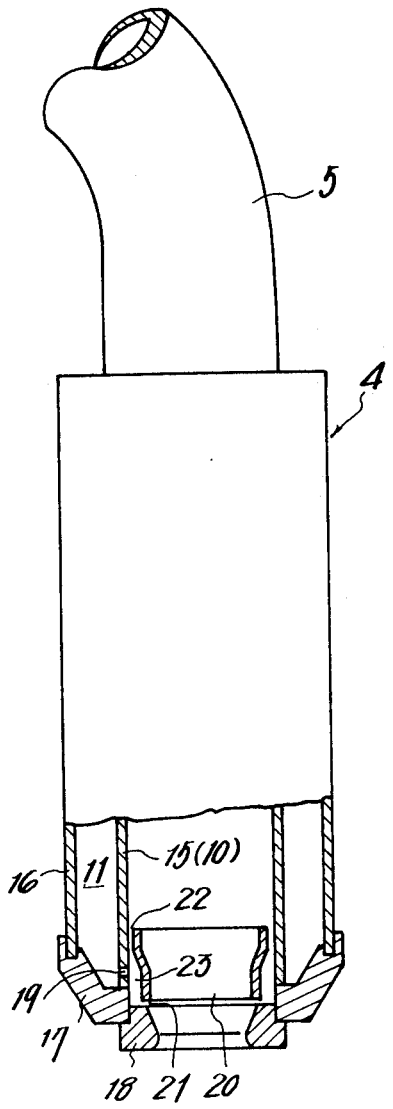
FIG. 2 is a front view showing an example of the basic structure of the suction head according to this invention, the view being partly broken away to show the principal part.

FIG. 2 shows an embodiment of the suction head of this invention useful in the scum removing apparatus described above. For a better understanding, FIG. 2 schematically shows the basic structure of the embodiment. A suction head 4 includes an inner tube 15 serving as a suction pipe 10 and an outer tube 16 forming a water cooling jacket 11. The tubes 15 and 16 have at their lower ends an end member 17 to which a suction mouthpiece 18 is attached. The inner tube 15 is formed with water ports 19 arranged at equal spacing circumferentially thereof. At the position of the water ports 19 inside the inner tube 15, there is provided an annular deflection or partition member 20 as spaced by a suitable distance from the inner peripheral surface of the inner tube 15. The partition member 20 divides the interior space of the inner tube 15 into a suction channel and a water flow channel extending into the nozzles to be described below. The partition member 20 forms a first nozzle 21 for forcing out water toward the axis of the inner tube 15, a second nozzle 22 for injecting water into the inner tube 15 along the inner peripheral surface thereof, and a branch portion 23 for deflecting water toward the nozzles 21 and 22. Thus according to this embodiment, a clearance is formed between the lower end face of the partition member 20 and the upper end face of the suction mouthpiece 18 to provide the first nozzle 21, and the clearance between the upper outer peripheral surface of the partition member 20 and the inner peripheral surface of the inner tube 15 provides the second nozzle 22. The clearance between the partition member 20 and the inner tube 15 serves as the branch portion 23 in communication with the nozzles 21 and 22. The water flow channel comprising the water ports 19 and the branch portion 23 maintains the interior of the water cooling jacket 11 in communication with the nozzles 21 and 22.

According to the structure described above, the water within the jacket 11 flows through the water ports 19 and branch portion 23 and is forced out from the nozzles 21 and 22 when the scum is sucked. The water forced out from the nozzle 21 toward the axis of the suction pipe cools and solidifies the sucked scum, while the water injecteed from the nozzle 22 into the inner tube 15 along the inner peripheral surface thereof prevents the scum from adhering to the inner peripheral surface of the inner tube 15. The water also hinders the direct contact of the scum with the inner surface of the inner tube 15, affording a muffling effect. Although the nozzles 21 and 22 are provided by the annular partition member 20 in the present embodiment, the nozzles 21 and 22 may alternatively be provided as separate members, or nozzles each adapted to inject water in a linear form may be arranged at equal spacing circumferentially of the suction pipe.

Another preferred embodiment will be described below with reference to FIG. 3. This embodiment comprises the embodiment of FIG. 2 which further includes shutter means 25 for closing the water flow channel. Stated more specifically, the inner tube 15 is provided, at the position of the water ports 19, with a tubular shutter member 26 fitting around the tube 15 and slidable to open and close the water ports 19. The shutter member 26 has an enlarged upper end serving as a piston portion 27 which is fittingly housed in an annular cylinder chamber 28 formed around the inner tube 15. The cylinder chamber 28 includes pressure chambers **29*a* and 29*b* at the upper and lower ends of the piston portion 27. By way of an electromagnetic switch valve 30, a pressure fluid is introduced into the chamber 29*a* or 29*b* in response to the switching action of the valve 30 to raise or lower the shutter member 26 and to thereby open or close the water ports 19. Indicated at 31 is a pump and at 32 an oil tank. These means are replaceable by an air compressor. The solenoid of the switch valve 30 operates in response to a signal from a pressure detector 12 disposed at an intermediate portion of the passage 5**.

Figure 3:
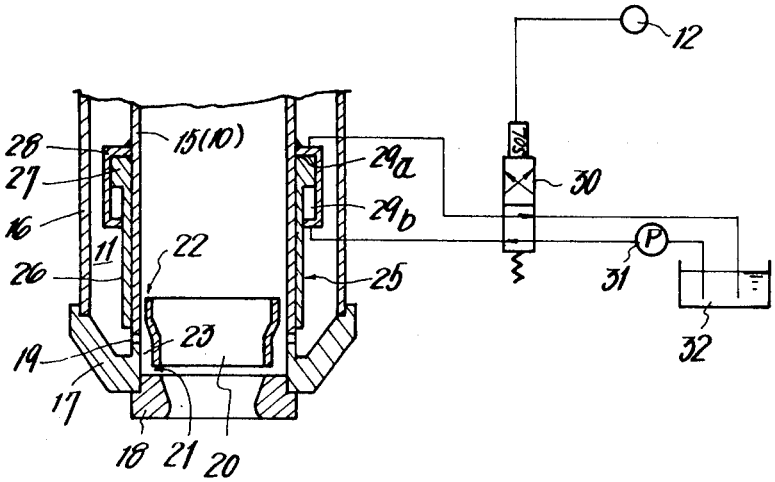
FIG. 3 is a front view partly in vertical section showing the basic structure of a preferred embodiment of this invention.

Should the suction channel become constricted due to the deposition of the scum on the inner surface of the inner tube 15 or of the passage 5, the negative pressure detected by the detector 12 builds up to an abnormally higher level than during normal operation, whereupon the switch valve 30 is changed over from the position shown in FIG. 3 in response to the detection signal, permitting the flow of the pressure fluid into the upper chamber **29*a*. Consequently, the shutter member 26 is pushed down, closing the water ports 19. Since the supply of water is stopped by the shutter means 25 provided immediately adjacent the nozzles 21 and 22, the injection of water from the nozzles 21 and 22 can be halted immediately in an emergency. Accordingly, when the suction in the vicinity of the scum inlet reduces due to the constriction or clogging of the suction channel, the injection of water can be stopped immediately, so that there is no possibility of the water falling onto the molten metal. The shutter member 26 is serviceable as safety means in an event of a malfunction of the suction means or a power failure, if the switch valve 30 is adapted to be changed over in response to a detecting signal from the pressure detector 12 or 13 when the suction means 8** produces a decreased suction or no suction due to the malfunction or power failure.

Instead of providing the pressure chamber **29*b*, the piston portion 27 may be biased upward at all times by a spring. Furthermore, the shutter member 26** may be so adapted as to be pushed up by the flow of water through the water flow channel.

Another preferred specific embodiment will be described below with reference to FIGS. 4 and 5. A suction head 4 includes an inner tube 35, an intermediate tube 36 and an outer tube 37 which form jackets **38*a* and 38*b* for cooling the suction head 4 with water. An end member 40 is secured to the lower end of the outer tube 37 and also to the lower end of a tubular sleeve 39 extending from the lower end of the inner tube 35. A suction mouthpiece 41 is detachably secured to the inner periphery of the lower end of the end member 40 so as to be replaceable when damaged. An annular partition member 42 integral with the end member 40 is positioned inside the sleeve 39. The lower end face of the partition member 42 and the upper end face of the suction mouthpiece 41 form a first nozzle 43 having an annular opening. The outer peripheral surface of the partition member 42 and the inner peripheral surface of the sleeve 39 provide a second nozzle 44. The junction between the end member 40 and the partition member 42 is formed with ports 42***a*. The sleeve 39 is formed with water ports 45 opposed to the partition member 42 and arranged at equal spacing circumferentially of the sleeve 39. The water ports 45 communicate with the outer water cooling jacket 38*a* via a water supply channel 47 between the outer tube 37 and a shutter supporting member 46 fixedly fitting around the intermediate tube 36. The ports 45 further communicate with the inner water cooling jacket 38*b* by way of a return channel 48. A shutter 50 prevents the supply of water to the ports 45 when the lower end thereof is in intimate contact with the end member 40. The shutter 50 is supported by the member 46 and the sleeve 39, is vertically slidable therebetween and has an upper piston portion 51 fitting in an annular cylinder chamber 52 defined by the shutter supporting member 46 and the sleeve 39. The cylinder chamber 52 includes an upper chamber 53*a* communicating with a first oil duct 54 within the inner jacket 38*b* via an oil port 55 in the sleeve 39, and a lower chamber 53*b* communicating with a second oil duct 56 within the jacket 38*b* via an oil port 57 in the shutter supporting member 46 as seen in FIG. 5. The shutter 50 is movable upward or downward by the hydraulic lift means 58 thus provided, by the pressure of oil introduced into the lower chamber 53*b* or the upper chamber 53*a*.

One of the water cooling jackets 38*a* and 38*b* is connected to an unillustrated water supply duct, while the other jacket is connected to a drain pipe (not shown) through which the amount of water in excess of the rate of injection of water is drawn off from the suction head, such that the suction head can be cooled effectively with a great amount of water exceeding the amount of water injected.

With the structure described above, the first and second nozzles 43 and 44, the shutter member 50, etc. operate basically in the same manner as in the embodiment of FIG. 3, giving substantially the same advantages. Preferably, the nozzles 43 and 44 are so designed that 70% of the whole amount of water to be injected will be applied through the first nozzle 43, and the remaining 30% through the second nozzle 44. The rate of flow of the water to the nozzles 43 and 44 supplied, for example, from the outer jacket 38*a*, as well as the pressure of the water, is maintained at a constant level by the provision of the water ports 45 and of the bypass including the return channel 48 extending to the inner jacket 38*b*, with the result that the above-mentioned water injection ratio can be accurately maintained at all times. Such return flow system also serves to eliminate local heating.

Figure 4:
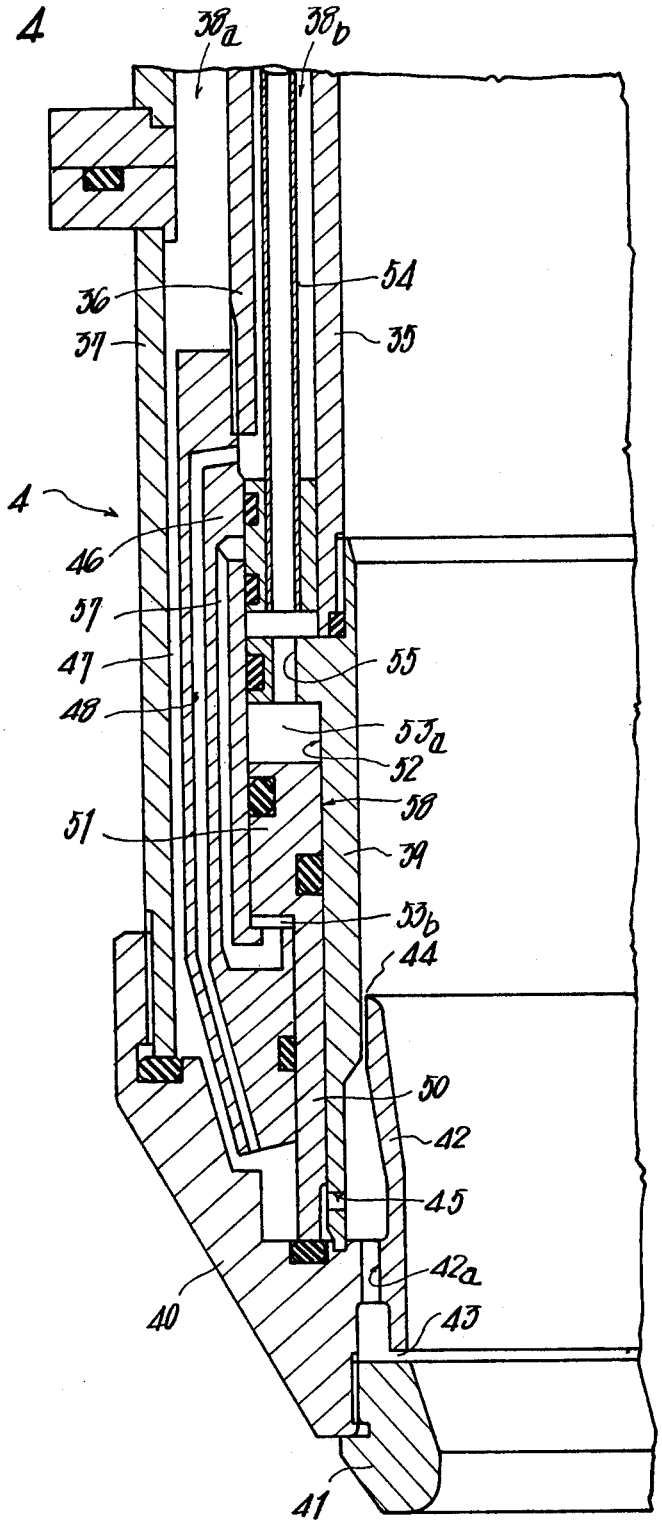
FIG. 4 is a fragmentary enlarged view in vertical section showing an exemplary specific structure of the embodiment of FIG. 3.
Figure 5:
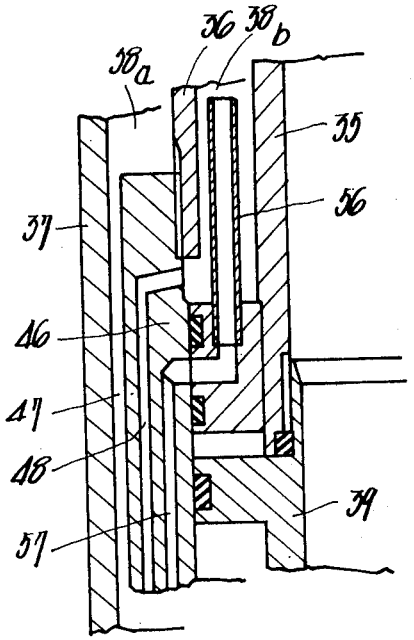
FIG. 5 is a fragmentary enlarged view in vertical section similar to FIG. 4 but showing the embodiment at a circumferentially different position.
Figure 6:
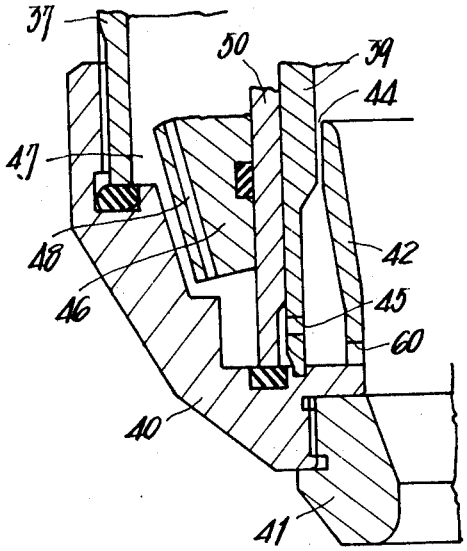
FIGS. 6 and 7 are fragmentary enlarged views in vertical section showing other specific embodiments of the suction head.

FIG. 6 shows a modification of the embodiment of FIG. 4. The modified embodiment has, in place of the first nozzle 43, orifices 60 extending radially through the annular partition member 42 and arranged at a suitable spacing circumferentially thereof. The orifices 50 serve as a first nozzle.

Figure 7:
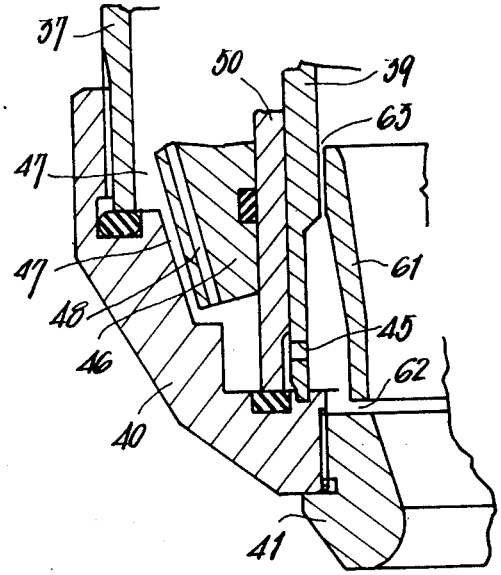

FIG. 7 shows another modification in which an annular partition member 61 is integral with the tubular sleeve 39 instead of being integral with the end member 40. The clearance between the lower end of the partition member 61 and the upper end of the suction mouthpiece 41 serves as the opening of a first nozzle 62. A second nozzle 63 is provided by orifices formed in the junction between the tubular sleeve 39 and the partition member 61. The first and second nozzles are not limited to the illustrated examples but can be modified variously.

What we claim is:

1. In a suction head for removing scum from the surface of a molten metal or the like including a suction pipe having a scum inlet, a water cooling jacket provided around the suction pipe and positioned at least close to the scum inlet, and water injecting means for injecting water in the jacket into the suction pipe close to the scum inlet, the improvement comprising:

the water injecting means including a first nozzle for forcing out water toward the axis of the suction pipe, and a second nozzle for forcing out water along the inner peripheral surface of the suction pipe.

2. A suction head as defined in claim 1 wherein the interior of the water cooling jacket is in communication with the first and second nozzles through a water flow channel comprising water ports formed in the suction pipe and maintaining the interior of the water cooling jacket in communication with the interior of the suction pipe and a branch portion formed on the inner periphery of the suction pipe and extending into the first and second nozzles.

3. A suction head as defined in claim 2 wherein the branch portion is defined by the inner wall of the suction pipe and an annular partition member spaced by a suitable distance from the inner wall, and the second nozzle has its opening defined by the inner peripheral surface of the suction pipe and the outer peripheral surface of one end of the partition member which end is positioned inwardly of the suction pipe.

4. A suction head as defined in claim 3 wherein the opening is in he form of an annular clearance.

5. A suction head as defined in claim 3 wherein the suction pipe has a suction mouthpiece defining the scum inlet, and the first nozzle has its opening provided by a clearance defined by the other end edge of the partition member at the scum inlet and by the end edge of the suction mouthpiece opposed to the other end edge of the partition member.

6. A suction head as defined in claim 3 wherein the opening of the first nozzle comprises a plurality of orifices formed in the partition member.

7. A suction head as defined in claim 2 wherein the interior of the water cooling jacket is divided into a radially inner water chamber and a radially outer water chamber in communication with each other in the vicinity of the water ports, one of the water chambers being adapted to receive therein a water supply, the other water chamber being adapted to discharge therefrom an excess of water not passing through the water ports.

8. A suction head as defined in claim 1 wherein the interior of the water cooling jacket is in communication with the first and second nozzles through a water flow channel provided with shutter means for closing the channel.

9. A suction head as defined in claim 8 wherein the water flow channel includes water ports formed in the suction pipe and maintaining the interior of the water cooling jacket in communication with the interior of the suction pipe, the shutter means comprising a tubular shutter member slidably fitting around the suction pipe at the position of the water ports.

10. A suction head as defined in claim 9 wherein the tubular shutter member has an enlarged end serving as a piston portion and fittingly housed in an annular cylinder chamber formed around the suction pipe.

11. A suction head as defined in claim 10 wherein the cylinder chamber includes a pair of pressure chambers positioned on the opposite ends of the stroke of the piston portion and each having a pressure fluid port.

* * * * *

UNITED STATES PATENT AND TRADEMARK OFFICE

CERTIFICATE OF CORRECTION

PATENT NO. : 4,077,615

DATED : March 7, 1978

INVENTOR(S) : KATSUMI NAGASAKI ET AL

It is certified that error appears in the above-identified patent and that said Letters Patent are hereby corrected as shown below:

Column 1, line 39, "peripheralsur-" should read -- peripheral sur- --;

Column 5, line 67, "50" should read -- 60 --;

Column 6, line 43, "he" should read -- the --.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*